US005384921A

United States Patent [19]

Zieg

[11] Patent Number: 5,384,921

[45] Date of Patent: Jan. 31, 1995

[54] METHOD OF TOPPING A SHOWER OR TUB ENCLOSURE

[76] Inventor: Steven A. Zieg, 24659 Las Patranas, Yorba Linda, Calif. 92687

[21] Appl. No.: 187,538

[22] Filed: Jan. 28, 1994

[51] Int. Cl.[6] ..... A47K 3/22; A61H 33/06

[52] U.S. Cl. ..... 4/609; 4/534

[58] Field of Search ..... 4/533, 534, 596, 597, 4/599, 600, 607, 608, 609, 610, 612, 614

[56] References Cited

U.S. PATENT DOCUMENTS

| | | | |
|---|---|---|---|
| 2,262,312 | 11/1941 | Blanch | 4/609 |
| 3,590,398 | 7/1971 | Jetter | 4/599 |
| 3,864,760 | 2/1975 | Bowen | 4/597 |
| 4,127,905 | 12/1978 | Bowen | 4/612 X |
| 4,365,368 | 12/1982 | Boggs | 4/596 |
| 4,545,083 | 10/1985 | Searson | 4/615 |
| 5,060,322 | 10/1991 | Delepine | 4/601 |
| 5,070,550 | 12/1991 | Reeves | 4/608 |

*Primary Examiner*—Robert M. Fetsuga
*Attorney, Agent, or Firm*—William W. Haefliger

[57] ABSTRACT

A shower or tub enclosure top protective device comprising a plastic sheet sized to extend across a shower or tub enclosure above the bather, the sheet having opposite end portions; two elongated rod structure respectively directly attached to the sheet end portions to be movable toward and away from one another, accompanied by flexing of the sheet; each rod structure having ends engageable against shower or tub wall structure to support the rod structure.

4 Claims, 2 Drawing Sheets

METHOD OF TOPPING A SHOWER OR TUB ENCLOSURE

BACKGROUND OF THE INVENTION

This invention relates generally to shower or tub enclosures, and more particularly to confinement or containment of vapor, heat or steam below the top and within such enclosures.

Taking a shower can often be a chilling experience, especially with housing developments in the past 10–15 years. Master baths have become increasingly larger; with many new homes featuring high cathedral ceilings, all of which allow the shower steam and warmth to dissipate rapidly. In addition, newer shower heads that comply with water conservation requirements simply do not yield the toasty, warm water flow of yesterday; and new, dual-setting thermostats keep the house cooler during the night; and early morning risers may find shower taking an even colder experience.

A few shower enclosure manufacturers now offer dome-topped enclosures with multiple water jets to give the toasty steam bath effect. But, the millions of existing shower enclosures lack such dome tops. There is a need for simpler means of providing for warmer showers in various sizes and styles of existing enclosures.

SUMMARY OF THE INVENTION

It is a major object of the invention to provide method and means satisfying the above need, in a very simple way, enabling rapid, easy installation and fitting of a capping means to shower or tub enclosures of all different sizes. It is also an object to provide such method and means wherein no rigid frame structure is required which dramatically reduces manufacturing costs and retail pricing to the user. This device allows easy user cutting and fitting of the vinyl sheet to individual shower size with simple rectangular measurements and cuts requiring no special patterns.

Basically, the protective device of the invention comprises, in combination:

a) a plastic sheet sized to extend across any typical shower or tub enclosure above the bather, the sheet having opposite end portions, b) two elongated rod means respectively directly inserted into the sheet loop portions to be movable toward and away from one another, accompanied by flexing/stretching of the sheet, c) each rod means having ends engageable against shower or tub wall structure, such as a rear wall, and a front frame above the shower door or shower curtain rod, to support the rod means.

As will be seen, the sheet has at least one loop at one of its end portions, one rod means received in the one loop; and the sheet has opposite edges, each extending between such end portions, the one loop extending between and to those opposite edges.

It is another object to provide for forming two such loops respectively at the sheet end portions, the two rod means respectively received in the end loops; and in which both loops are easily formed as by the user to extend between and to the sheet opposite edges, the spacing between the two loops being user selected as by first installing the rod means in the shower enclosure and measuring the distances between the rods at their ends, such measurement then used to establish the loop spacing, whereby the device is easily custom fit by the user to his or her particular shower, no sizing or use of frames being required.

Yet another object is to provide a method wherein each such loop is easily defined by a folded back sheet end portion, and an adhesive means securing the loop, rather than staples, which could rust.

These and other objects and advantages of the invention, as well as the details of an illustrative embodiment, will be more fully understood from the following specification and drawings, in which:

DRAWING DESCRIPTION

DETAILED DESCRIPTION

Figure 1:
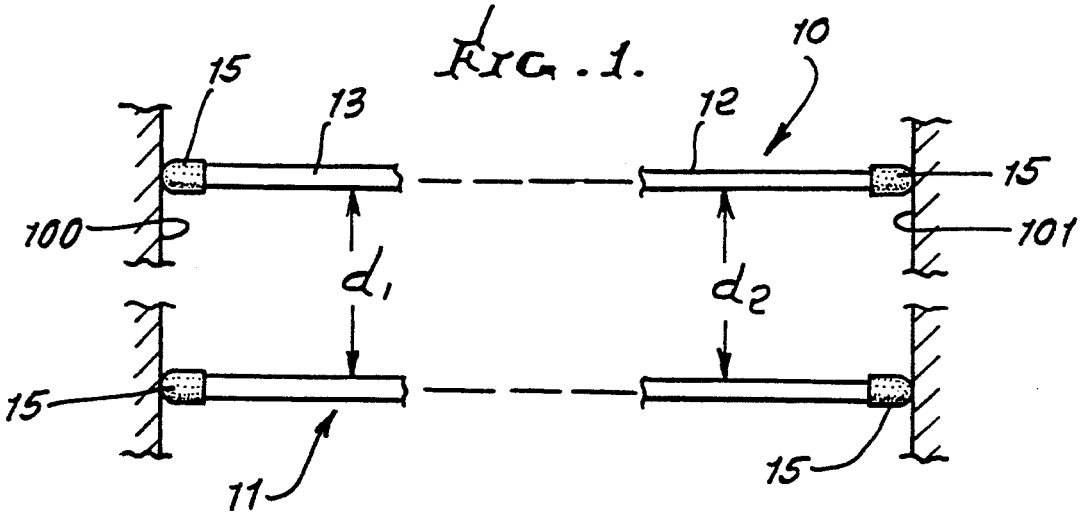
FIG. 1 is a plan view of the upper extent of a shower enclosure showing initial fitting of two rod means in position at selected height.
Figure 4:
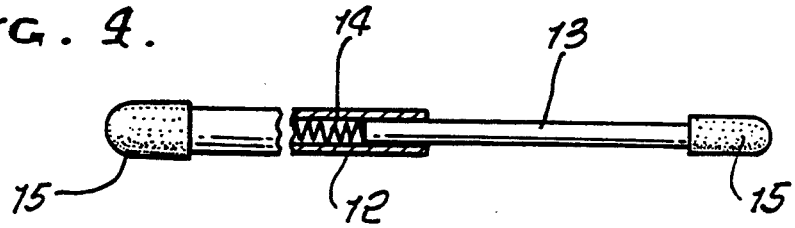
FIG. 4 is a section taken through a rod means.

FIG. 1 shows pre-fitting of two elongated rods 10 and 11 in a shower enclosure at selected height, as for example near the top of the enclosure. Rod ends 15 engage the shower rear wall 100 and front wall 101 above the enclosure door or opening. The rods may take the form, as seen in FIG. 4, having telescoping sections 12 and 13, urged in opposite endwise direction, as by an internal coil spring 14. Rubber end caps 15 on the section engage the enclosure opposite vertical walls 16 and 17, to frictionally hold the rods in place. After FIG. 1 installation, the distances $d_1$ and $d_2$ between the rod ends are measured.

Figure 2:
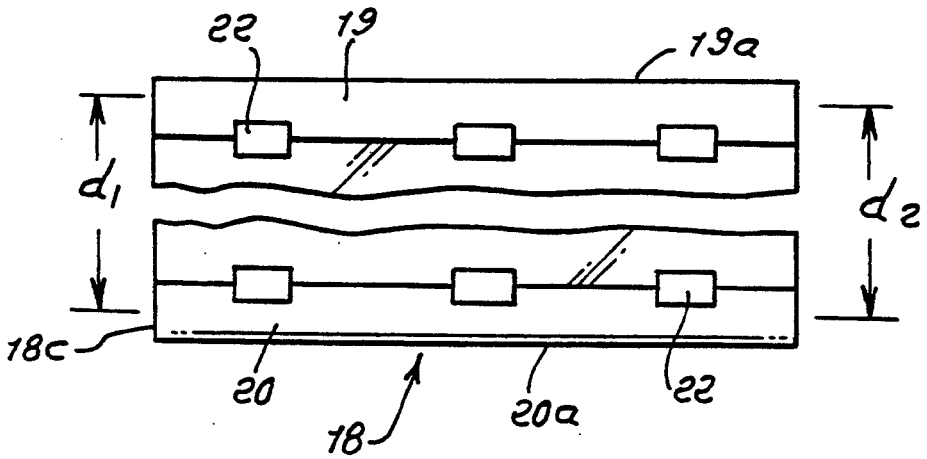
FIG. 2 is a view showing forming of an enclosure capping sheet, to size, with loops.

Next, a flexible, plastic sheet 18 is laid out on a surface as on a floor, and end loops formed at 19 and 20, at the same distances apart, i.e., $d_1$ and $d_2$. See FIG. 2. The two loops may be formed by folding the sheet ends back, as at end portions 19*a* and 20*a*. The loops extend between sheet opposite edges 18*c* and 18*d*. Such edges may be initially sized (apart) by cutting the sheet to shower stall width and size, to retain steam. Adhesive tape sections 22 may be applied to the folded back sheet edge portion to retain the loops in position. Sheet 18 is typically transparent.

Figure 3:
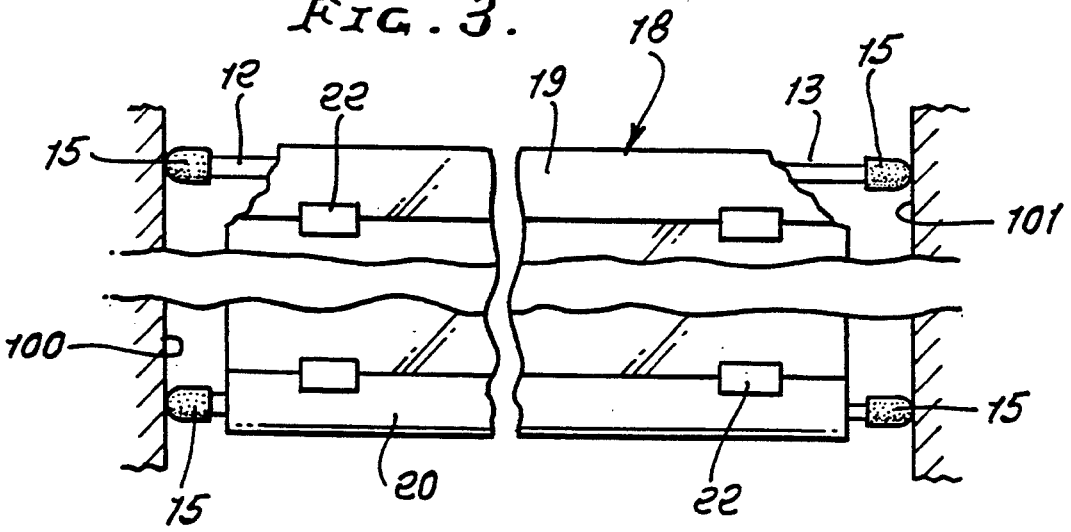
FIG. 3 is a view like FIG. 1 showing the two rods received in the loop and reinstalled in the shower enclosure.

Next, the rods 10 and 11 are inserted into the loops and are received loosely in such loops, and reinstalled in the shower enclosure, as seen in FIG. 3, i.e., at selected height and separation at distances $d_1$and $d_2$ or close to the latter. The sheet 18 is thereby supported in stretched out or nearly stretched out position, as described, no framing being required. The sheet may consist of clear vinyl; and it is seen to cap or enclose the top of the shower enclosure, to retain steam and warm vapor in the shower area occupied by the bather.

Figure 5:
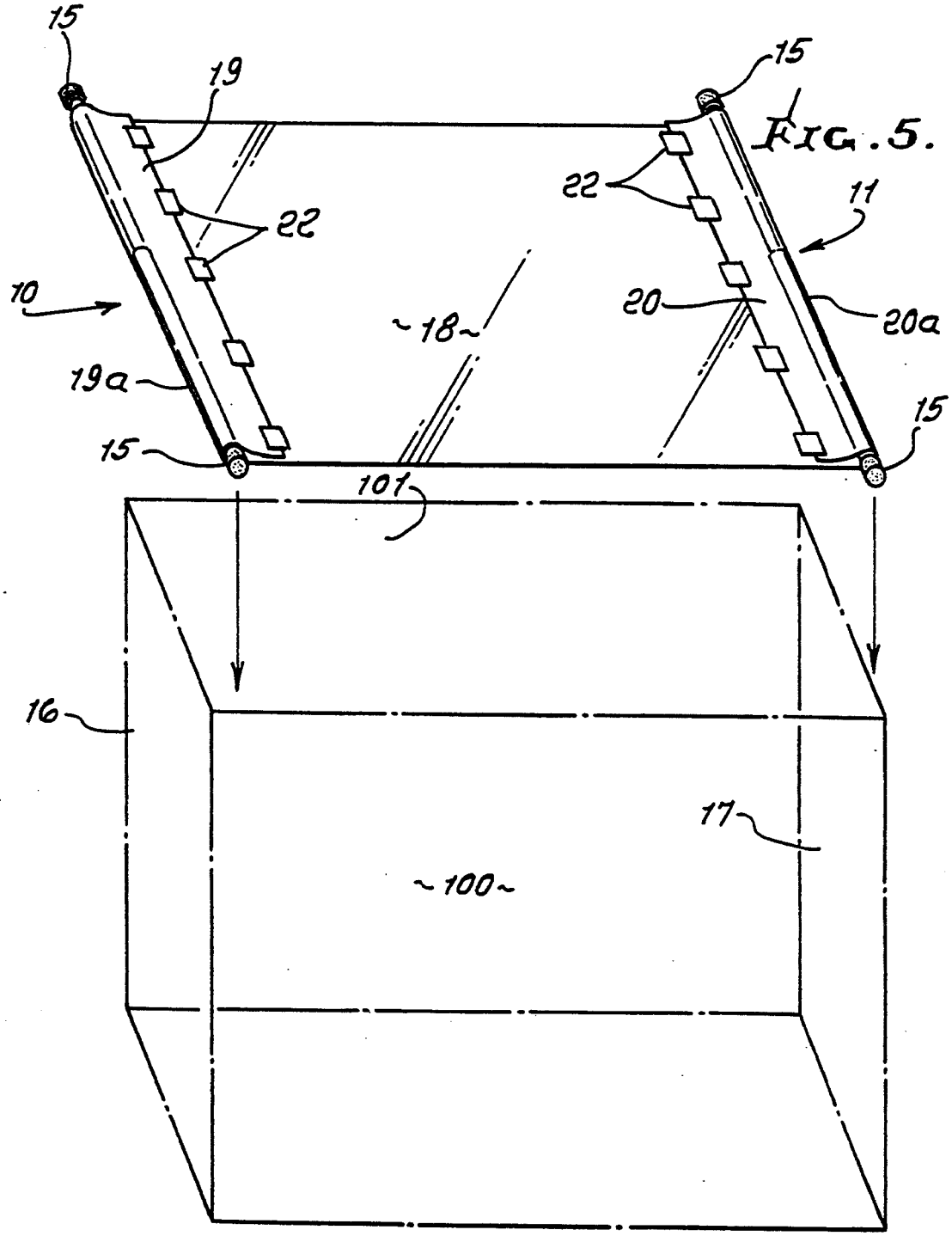
FIG. 5 is a perspective exploded view showing installation of the device in a shower enclosure.

Elements are also seen in FIG. 5.

The rods 10 and 11 may be of screw thread interfitting section type; and the spring may or may not be needed, since the rubber end caps are yieldably compressible to act as compression springs.

The steps of the method of the invention may be summarized as follows:

i) installing the rod means in the shower enclosure in selected parallel positions, projecting toward front and back walls, ii) measuring the distance between the rod means at the ends thereof engaging the wall structure, iii) removing the rod means from the enclosure, iv) spreading the sheet on a support surface and forming the loops 19 and 20 at the sheet end portions, at separations corresponding to the measured distances, v) inserting the rod means in the loops, vi) and installing the rod means in the shower enclosure to endwise engage the wall structure, with the sheet supported by and stretched between the two rod means.

Benefits of the invention are as follows:

1) Provides a warmer, steamy shower.

2) Requires less hot water flow; saves water and heating energy.

3) Eliminates steamed mirrors in bathroom.

4) Provides added comfort, for example, to shave legs.

5) Enclosure then stays warm enough to enable water turn-off, while lathering.

6) User dries off in warm enclosure, rather than stepping out into the cold.

7) Installation is not air-tight. Allows shower to "breathe" or dry out between uses, so that there is no increase in mildew growth.

8) Allows easy rod adjustment in the enclosure, toward or away from one another, or up or down, individually.

I claim:

1. The method of installing a shower or tub enclosure top protective device, comprising in combination:

a) plastic sheet sized to extend across a shower or tub enclosure above the bather, the sheet having opposite end portions, b) two elongated rods respectively directly attached to said sheet end portions to be movable toward and away from one another, accompanied by flexing of said sheet, c) each said rod having ends engageable against shower or tub wall structure to support the rod, d) said sheet having two loops respectively at said end portions, said two rods respectively received in said end loops, said method including the steps:

i) installing the rods in the shower enclosure in selected parallel positions, ii) measuring the distances between said installed rods at said ends thereof engaging said wall structure, iii) removing the rods from said enclosure, iv) spreading the sheet on a support surface and forming said loops at said end portions at separations corresponding to said measured distances, v) inserting said rods in said loops, vi) and installing said rods in the shower enclosure to endwise engage said wall structure, with said sheet supported by and stretched between said two rods.

2. The method of claim 1 including providing each rod to have rod sections and spring means for urging said rod sections toward said wall structure.

3. The method of claim 2 wherein each rod end is provided to include an end cap for frictional engagement with said wall structure.

4. The method of claim 1 wherein each loop is provided to have a folded back sheet end portion, and an adhesive means securing the loop.

* * * * *